US007481092B1

(12) United States Patent
Sperko

(10) Patent No.: US 7,481,092 B1
(45) Date of Patent: Jan. 27, 2009

(54) DIMPLER AND METHOD

(76) Inventor: Walter J. Sperko, 4803 Archwood Dr., Greensboro, NC (US) 27406

( * ) Notice: Subject to any disclaimer, the term of this patent is extended or adjusted under 35 U.S.C. 154(b) by 0 days.

(21) Appl. No.: 12/070,633

(22) Filed: Feb. 20, 2008

(51) Int. Cl.
*B21D 19/10* (2006.01)

(52) U.S. Cl. ..... 72/414; 72/370.01; 72/370.04; 72/409.19; 72/451; 219/149; 227/62; 227/66; 227/154

(58) Field of Classification Search ..... 72/409.19, 72/317, 414, 451, 453.15, 453.16, 370.01, 72/20.2, 21.3, 342.8, 370.1, 370.04; 219/149; 227/62, 66, 154
See application file for complete search history.

(56) References Cited

U.S. PATENT DOCUMENTS

| | | | | |
|---|---|---|---|---|
| 2,375,707 | A * | 5/1945 | Speller | 72/358 |
| 2,438,842 | A * | 3/1948 | Christensen | 72/414 |
| 2,442,949 | A * | 6/1948 | Fischer | 72/407 |
| 2,592,672 | A * | 4/1952 | Fischer | 72/20.2 |
| 2,956,148 | A * | 10/1960 | Shoebridge et al. | 72/342.8 |
| 2,966,195 | A * | 12/1960 | Roberts et al. | 72/343 |
| 6,269,674 | B1 | 8/2001 | Sperko | 72/409.19 |
| 7,013,699 | B1 | 3/2006 | Sperko | 72/409.19 |

* cited by examiner

*Primary Examiner*—David B Jones

(57) ABSTRACT

A dimpler includes a frame supporting a fluid cylinder which drives a ram toward a platen to press a dimple into a pipe fitting or other object. A method of dimpling or redimpling pipes or fittings is also described.

20 Claims, 5 Drawing Sheets

DIMPLER AND METHOD

FIELD OF THE INVENTION

The invention herein pertains generally to a dimpler, and more particularly, to a dimpler including a ram driven by a compressed fluid to form a dimple in a pipe fitting for precise brazing purposes.

DESCRIPTION OF THE PRIOR ART AND OBJECTIVES OF THE INVENTION

Pipes, tubes, fittings and other like objects, particularly of copper are usually joined by inserting one pipe having a small diameter with sufficient depth into a larger diameter pipe and then soldering or brazing the joined pipes, so a strong, durable joint is formed. Brazed joints are generally not as deep as soldered joints. U.S. Pat. Nos. 6,269,674 and 7,013,699 both disclose hand tools used for dimpling pipes to control the depth of insertion of the smaller pipe. Should a lot of pipes need to be joined in a timely manner, dimpling pipes or fittings by hand can be slow, difficult, laborious and inefficient. Also, hand tools may not provide an adjustment means for varying the depth of pipe insertion according to the particular dimpling requirements.

To address these and other disadvantages of prior art tools, the present invention was conceived and one of its objectives is to provide an automated device and method for dimpling pipes and pipe fittings for softer metals such as copper.

Another objective of the present invention is to provide a dimpler having a cylinder that can be driven by a supply of pressurized fluid.

Yet another objective of the present invention is to provide a dimpler with an adjustable rest for pressing dimples into a fitting at uniform distances from an end of the fitting and for varying the distance of the dimples from the end of the fitting.

Still another objective of the present invention is to provide a dimpler capable of dimpling pipes or fittings with greater wall thicknesses than conventional hand-held dimplers.

Yet still another objective is to provide a method of redimpling pipes and fittings for brazing at a lesser depth or length than previously dimpled for soldering.

Various other objectives and advantages of the present invention will become apparent to those skilled in the art as a more detailed description is set forth below.

SUMMARY OF THE INVENTION

The aforesaid and other objectives are realized by providing a dimpler that includes a frame supporting a cylinder that drives a ram toward a platen for pressing a dimple in a pipe, fitting or other like object. In the preferred embodiment of the dimpler, a handle controls the flow of pressurized fluid in a pneumatic cylinder by operating a valve in communication with entry and exit ports of the cylinder. Opening one port of the valve and closing the other directs the pressurized fluid into the cylinder to force the ram against, for example a fitting. Next, closing the one port and opening the other directs the pressurized fluid to atmosphere to release the ram and allow a spring to withdraw the ram from the fitting and into the ram housing. A threaded adjuster controls the rate of release of the fluid. A method of dimpling a pipe or fitting includes placing the fitting on the rest and operating the handle to open and close the ports to drive and withdraw the ram into and from the fitting.

DETAILED DESCRIPTION OF THE PREFERRED EMBODIMENTS AND OPERATION OF THE INVENTION

Figure 1:
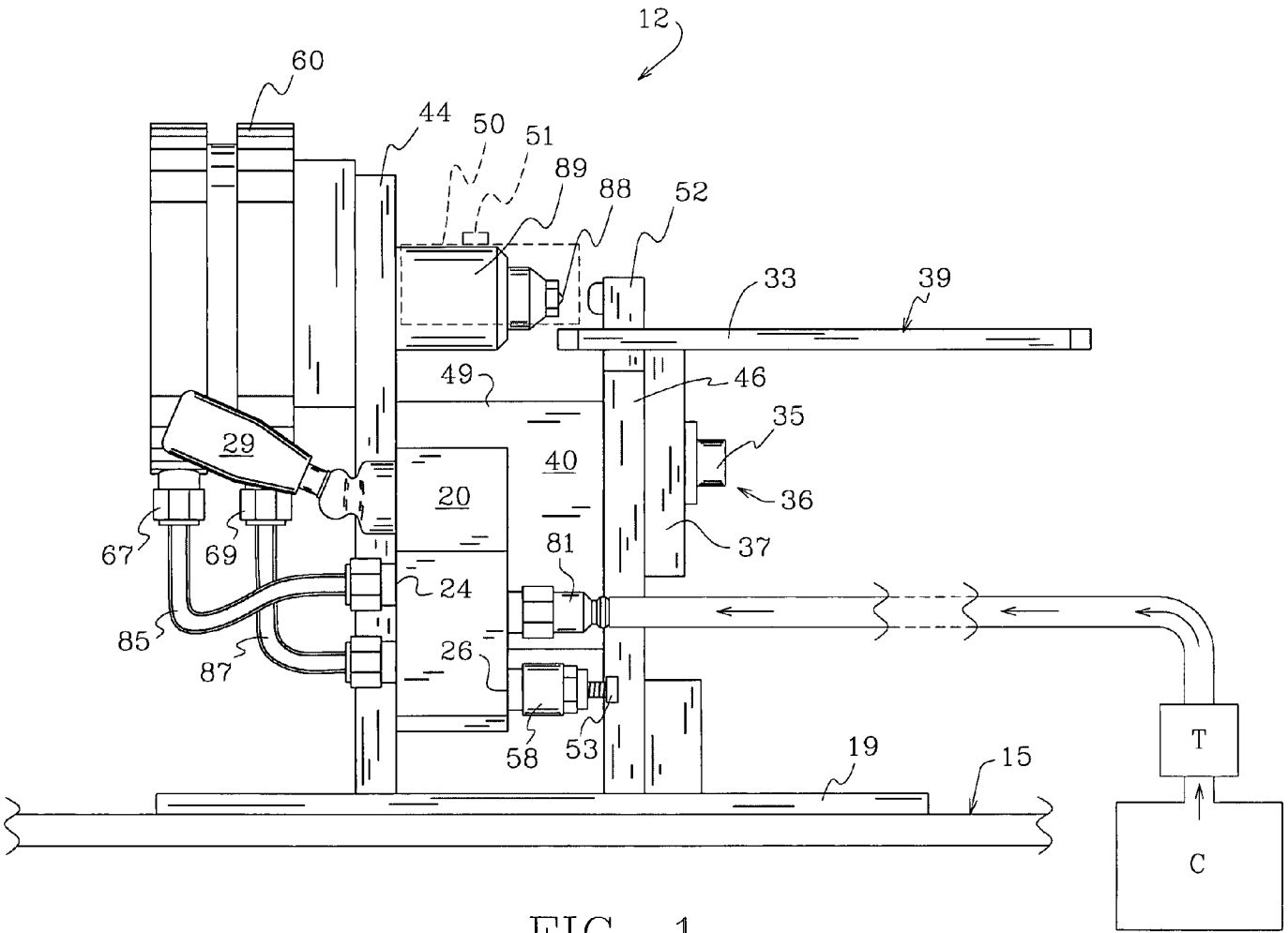
FIG. 1 is a side elevational view of the dimpler of the invention, with an optional protective shroud shown in ghost form.
Figure 3:
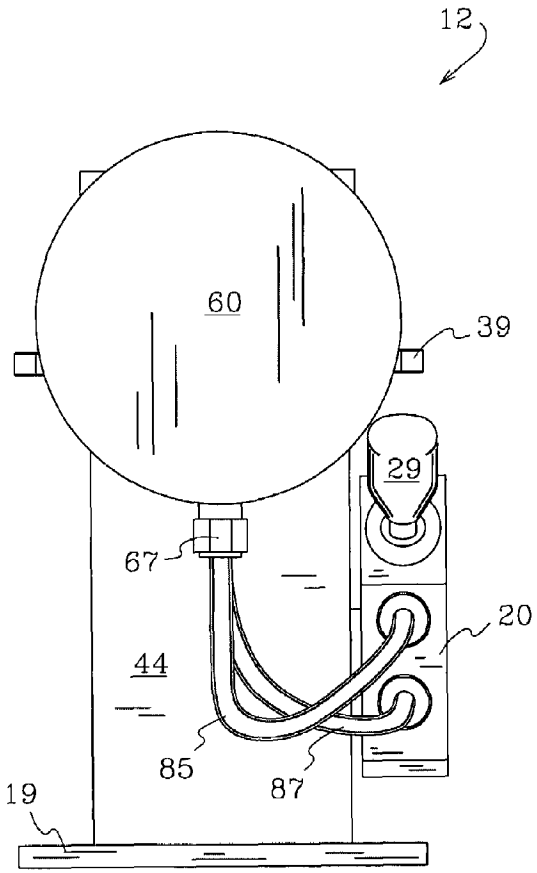
FIG. 3 is a front elevational view of the dimpler.
Figure 2:
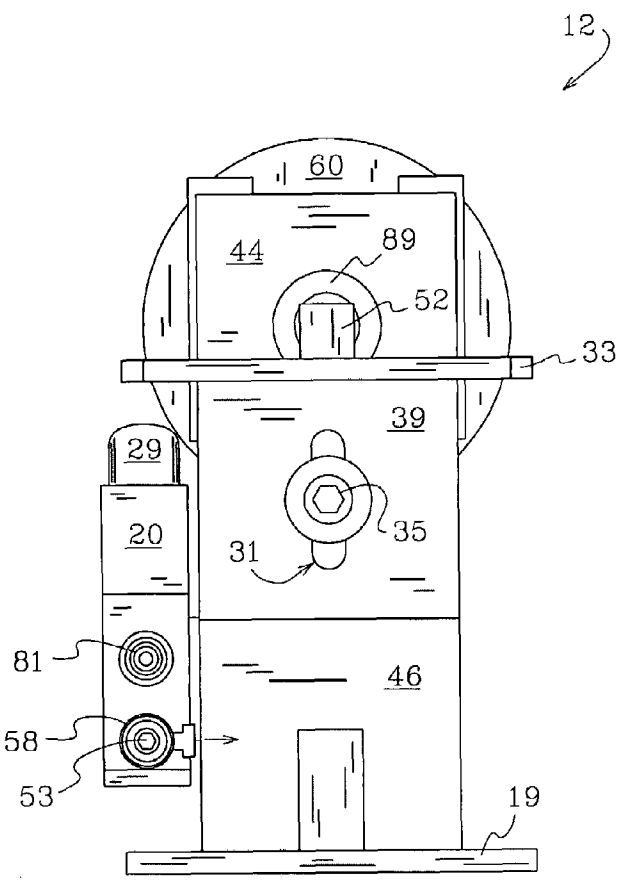
FIG. 2 is a rear elevational view of the dimpler shown in FIG. 1 but without the shroud.
Figure 4:
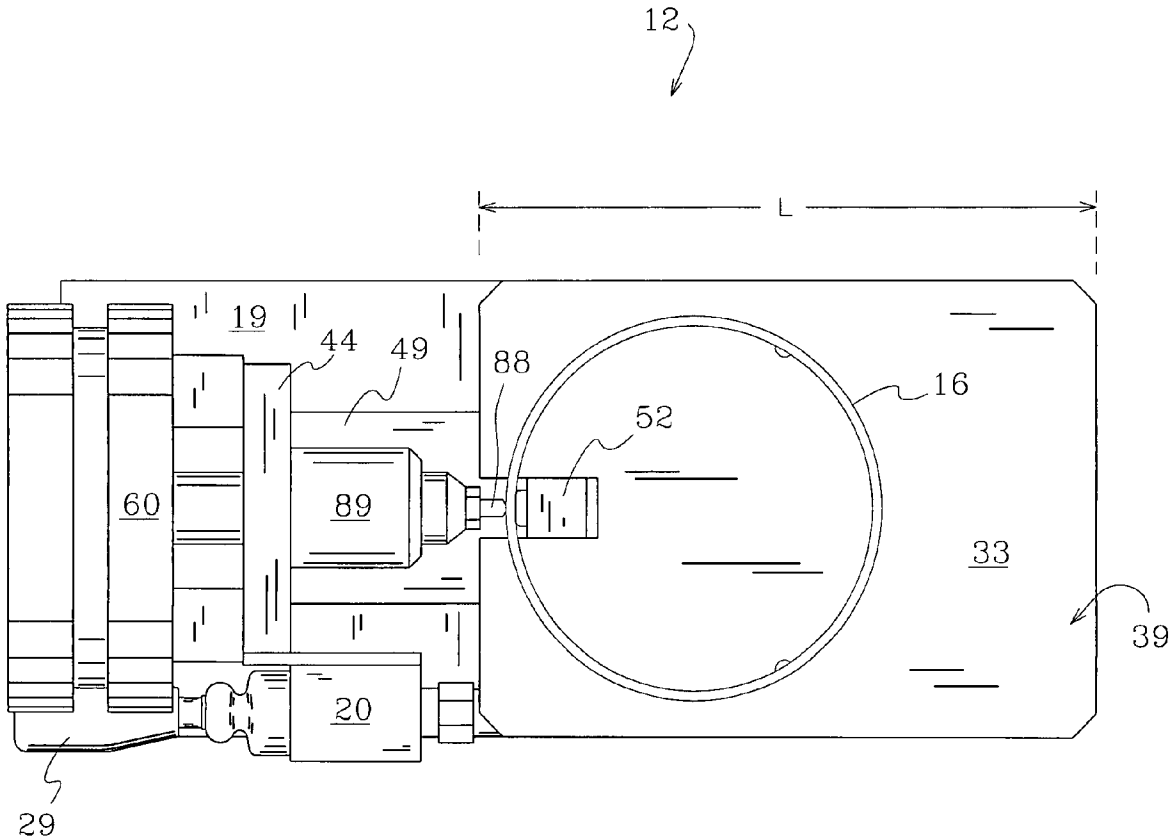
FIG. 4 is a top plan view of the dimpler with a fitting positioned thereon with the ram extended for dimpling purposes.

For a better understanding of the invention and its operation, turning now to the drawings, FIGS. 1-3 show the preferred embodiment of dimpler 12 including frame 40 as formed from steel plates for supporting cylinder 60 used for driving ram 88 toward platen 52 which is spaced apart from ram housing 89 for placement of a fitting 16 therebetween as seen in FIG. 4.

Preferably, frame 40 shown positioned schematically on table top 15 includes beam 49 fixedly spacing apart pillars 44, to form or approximate, with platen 52, an h-shaped structure mounted on base 19. Base 19 extends longitudinally parallel with or nearly parallel with the movement of ram 88, such as toward platen 52. Longitudinal axis L of rest 39 is seen in FIG. 4. Rest 39 is connected to pillar 46.

Figure 6:
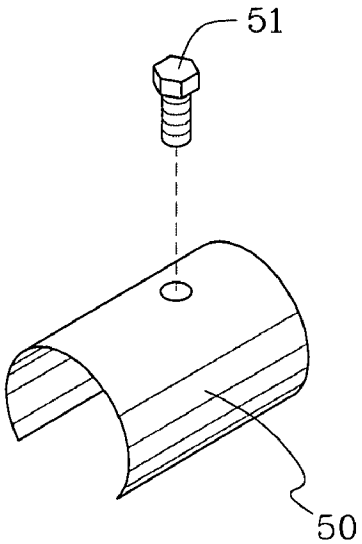
FIG. 6 is a top perspective view of a shroud removed from the dimpler.

Conventional cylinder 60 is preferably pneumatic and is fixed to pillar 44. Adjustment means 36 for changing the vertical position of T-shaped rest 39 in relation to platen 52 includes elongated opening or slot 31 defined by leg 37 of rest 39 and bolt 35. Rest 39 can therefore be clamped or tightened against pillar 46 with bolt 35 at the desired height. Shelf 33 of rest 39 is affixed by welding or the like to leg 37. Alternatively, or additionally, dimpler 12 can be constructed to include a threaded rod and nut, a lock pin system, a gear drive system or another device for vertically adjusting rest 39. Optional inverted U-shaped shroud 50, which is formed from metal or other suitable material is also shown in FIG. 6 and can be bolted to, such as with bolt 51 into a threaded channel (not seen), or otherwise fastened on ram housing 89 to protect an operator from hand or finger injury which may be caused by ram 88.

In the preferred dimpler form, ram 88 reciprocates horizontally as shown in FIG. 4 at one end of cylinder 60 from housing 89 in response to changes in fluid pressure in cylinder 60 which is controlled by valve 20. Valve 20 is mounted to pillar 44 and operated by handle 29. Opening an upper and sealing a lower port (not seen) of valve 20 directs the fluid through passage 24, conduit 85 and cylinder entry port 67 to the interior of cylinder 60, which extends ram 88 toward platen 52 in a horizontal path, approximately parallel to base 19. Closing the upper and opening the lower port of valve 20 directs pressurized fluid in cylinder 60 through exit port 69, conduit 87 and passage 26 to exit valve 58, seen in FIGS. 1 and 2 which allows ram 88 to be withdrawn by spring action from platen 52. A coil spring inside ram housing 89 is not seen here. Exit valve 58 includes threaded adjuster 53 for regulating the rate at which pressurized fluid cylinder 60 exits valve 58 and enters the atmosphere. While dimpler 12 is preferably pneumatically operated, hydraulics or electrical power could also be accommodated if desired.

Pressurized fluid supply takes the form of air pressurized by conventional air compressor C and stored in tank T in the preferred embodiment of the invention as shown schematically in FIG. 1. An air hose fitted to adapter 81 on dimpler 12 directs pressurized air from storage tank T to valve 20 in a conventional manner.

With reference primarily to FIGS. 4, 5, 6, 7A and 7B, the preferred method of joining pipes includes adjusting T-shaped rest 39 with respect to platen 52 to set the height distance from bottom or end 97 (FIG. 5) of pipe or fitting 16 to the desired position of dimple 92. Fitting 16 is placed on shelf 33 of rest 39 against or nearly against platen 52 in the position where dimple 92 is desired as shown particularly in FIG. 4.

Figure 5:
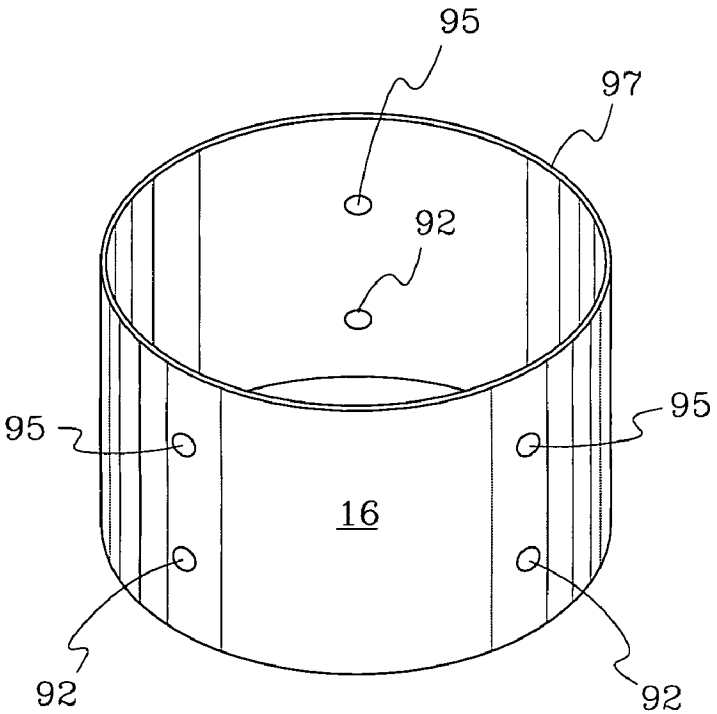
FIG. 5 is a top perspective view of a dimpled fitting.

Depressing handle 29 opens the upper port and closes the lower port of valve port 20, which urges ram 88 toward platen 52 to press dimple 92 as pressurized fluid enters cylinder 60. Raising handle 29 closes the upper port and opens the lower port of valve 20 to allow ram 88 to retract from platen 52 by spring tension while directing pressurized fluid from cylinder 60. A coil spring (not shown) maintained within ram housing 89 assists in the retraction of ram 88. Threaded adjuster 53 (FIGS. 1 and 2) can be manipulated to control the release rate of pressurized fluid through exit valve 58. Fitting 16 is then rotated on shelf 33 of rest 39 to press another dimple 92 therein in uniform fashion. Three dimples 92 as seen in FIG. 5 are preferred, but more or less dimples may be used in particular circumstances.

Figure 7A:
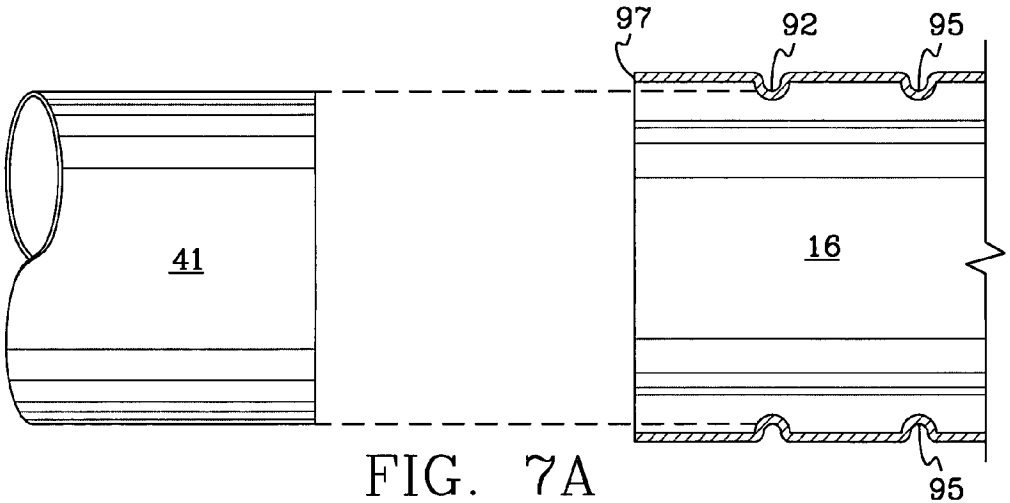
FIG. 7A is a side elevational view of a small pipe exploded from a fitting seen in cross-section.
Figure 7B:
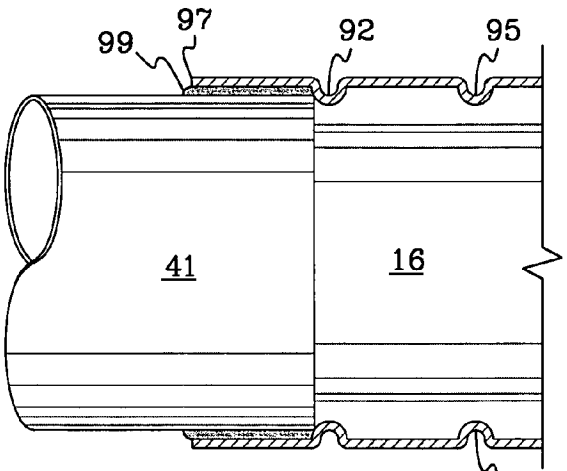
FIG. 7B is a side elevational view of the small pipe as inserted in the fitting and brazed thereto.

The preferred method includes pressing three equally spaced apart dimples 92 (FIG. 5) in fitting 16 and inserting smaller pipe 41 into fitting 16 as demonstrated in FIGS. 7A and 7B. Fittings 16 are shown with old dimples or grooves 95 which are deeper into the fitting, for use in soldering pipe 41 into fitting 16. Dimples 92 control the depth of insertion of smaller pipe 41 to provide a shorter overlap between smaller pipe 41 and fitting 16 more suitable for brazing. A standard brazing operation can be performed with filler metal 99 to secure pipe 41 to fitting 16.

The illustrations and examples provided herein are for explanatory purposes and are not intended to limit the scope of the appended claims.

I claim:

1. A dimpler comprising: a ram, a platen, said platen spaced from said ram for receiving an object thereon, a base, a pillar, said pillar mounted on said base, a rest, said rest adjustably affixed to said pillar, said platen mounted on said pillar, a cylinder, said cylinder attached to said ram for driving said ram, an entry port, an exit port, said entry port and said exit port positioned on said cylinder, a valve, said valve in fluid communication with said entry port and said exit port, said valve for directing fluid through said entry port to cause said ram to extend and dimple an object positioned on said platen.

2. The dimpler of claim 1 further comprising a handle, said handle positioned on said valve for operating said ram.

3. The dimpler of claim 1 wherein said cylinder comprises a fluid cylinder.

4. The dimpler of claim 3 wherein said fluid cylinder comprises a pneumatic cylinder.

5. The dimpler of claim 1 wherein said ram comprises a rod.

6. The dimpler of claim 1 further comprises a ram housing, said ram contained within said ram housing, a shroud, said shroud attached to said ram housing proximate said ram.

7. The dimpler of claim 1 wherein said rest is vertically adjustable.

8. The dimpler of claim 7 further comprising a means to adjust said rest, said adjusting means affixed to said rest and to said pillar, said rest comprising a T-shape.

9. A dimpler for use in brazing tubular members comprising: a frame, a fluid cylinder, said fluid cylinder attached to said frame, a ram, said ram movably attached to said fluid cylinder, a platen, said platen opposingly positioned to said ram for receiving said ram, said platen affixed to said frame, a rest, said rest proximate said platen, an entry port, an exit port, said entry port and said exit port located on said fluid cylinder, a valve, said valve for controlling fluid supply to said fluid cylinder.

10. The dimpler of claim 9 wherein said fluid supply comprises air.

11. The dimpler of claim 10 wherein said fluid supply comprises a compressor.

12. The dimpler of claim 9 further comprising a base, said frame mounted on said base, a pillar, said rest attached to said pillar, said pillar attached to said base.

13. The dimpler of claim 9 wherein the movement of said ram is parallel to the longitudinal axis of said rest.

14. The dimpler of claim 9 further comprising a valve handle, said valve handle attached to said valve for controlling said valve.

15. The dimpler of claim 9 further comprising a threaded adjuster, said threaded adjuster affixed to said valve.

16. The dimpler of claim 9 further comprising a ram housing, said ram contained within said ram housing, a shroud, said shroud attached to said ram housing.

17. The dimpler of claim 12 wherein said platen is mounted proximate said ram.

18. The dimpler of claim 9 wherein said frame is h-shaped.

19. The method of placing a dimple in a fitting utilizing a dimpler having a fluid cylinder which drives a ram, the fluid cylinder controlled by a handle affixed to a fluid control valve joined to a pressurized fluid source, the dimpler also having an adjustable rest adjustably mounted on a pillar affixed to a base, the method comprising the steps of:

a) adjusting the rest along the pillar;

b) placing a fitting on the rest; and c) extending the ram with the handle to dimple the fitting.

20. The method of claim 19 further comprising the step of:

a) shrouding the ram;

b) adjusting the rest to accommodate the fitting; and c) extending the ram horizontally to dimple the fitting.

* * * * *